United States Patent [19]

Backman et al.

[11] Patent Number: 4,885,994

[45] Date of Patent: Dec. 12, 1989

[54] ARMOR PENETRATION RESISTANCE ENHANCEMENT

[75] Inventors: Marvin E. Backman; Stephen A. Finnegan, both of Ridgecrest; Kent G. Whitman, Inyokern; Robert G. S. Sewell, Ridgecrest, all of Calif.

[73] Assignee: The United States of America as represented by the Secretary of the Navy, Washington, D.C.

[21] Appl. No.: 494,839

[22] Filed: May 16, 1983

[51] Int. Cl.[4] ..... F42B 13/48

[52] U.S. Cl. ..... 102/473; 102/481; 89/36.02

[58] Field of Search ..... 102/473, 481, 293, 517–519; 244/3.15, 3.16; 89/36 A, 36.02

[56] References Cited

U.S. PATENT DOCUMENTS

| | | | |
|---|---|---|---|
| 3,559,210 | 2/1971 | Hansen | 2/2.5 |
| 3,582,398 | 6/1971 | Ringler | 117/33.3 |
| 3,700,534 | 10/1972 | Cook | 161/38 |
| 3,859,892 | 1/1975 | Coes | 89/36 A |
| 3,992,997 | 11/1976 | McCubbin et al. | 102/481 |
| 4,064,314 | 12/1977 | McKenzie | 428/483 |
| 4,107,391 | 8/1978 | Moore et al. | 428/483 |
| 4,131,053 | 12/1978 | Ferguson | 89/36 A |
| 4,198,468 | 4/1980 | Molari | 428/412 |
| 4,242,414 | 12/1980 | McKenzie | 428/412 |
| 4,309,484 | 1/1982 | Ohmae et al. | 428/441 |
| 4,316,404 | 2/1982 | Medlin | 89/36 H |
| 4,423,683 | 1/1984 | Telmo | 102/481 |

*Primary Examiner*—Harold J. Tudor

*Attorney, Agent, or Firm*—Sol Sheiinbein; Melvin J. Sliwka

[57] ABSTRACT

A metal cup encloses layers of armoring material to enhance the penetration resistance of a guided missile warhead to mechanical countermeasures. A layer of ceramic material is inserted in the cup followed by the insertion of at least one pair of layers consisting of a layer of metal backed by a layer of polymethylmethacrylate. The metal cup is attached to the forward end of a missile warhead section and the exterior of the cup is conformal with respect to the exterior of the warhead section. The layered materials act to blunt or break incoming projectiles, absorb their kinetic energy, and prevent their penetration into the interior of the warhead.

10 Claims, 1 Drawing Sheet

ARMOR PENETRATION RESISTANCE ENHANCEMENT

BACKGROUND OF THE INVENTION

1. Field of the Invention

The present invention relates to armoring material and an arrangement thereof. More particularly, this invention relates to an arrangement incorporating armoring material to enhance the resistance of a long range land or surface attack guided missile warhead section to penetration and destruction by mechanical countermeasures such as gun projectiles.

2. Description of the Prior Art

Currently, protection of guided missile warhead sections from mechanical countermeasures involves the thickening of the forward facing end of the metal encasement which forms the warhead section and encloses the warhead explosive. By way of background it is useful to note that in many guided missile configurations the warhead section is not the forwardmost section of the missile. Oftentimes a guidance, control or other section is located forward of the warhead. At the range at which mechanical countermeasures, such as gun shells, can be expected to be encountered "head-on" by a long range missile the sections of the missile forward of the warhead have essentially accomplished their task of bringing the warhead to a target. At this point in the flight of the missile, protection of the warhead and its fuzing becomes the paramount concern. As noted, warhead protection currently relies on the thickening of the forward end of the warhead encasement. Where the warhead is not the forwardmost section of a missile, the forward end of the warhead encasement must also accommodate the mounting of the missile section forward of it.

The degree of protection from mechanical countermeasures offered by a thickened forward encasement end has heretofore been a function of the amount of thickening which could be tolerated in terms of added weight to the missile. As warhead encasements are generally fabricated from steel, encasement thickening rapidly adds a significant amount of weight to the missile where the facial area of the warhead encasement can be on the order of 300 square inches or more. While a thickened encasement may provide adequate protection for the warhead from mechanical countermeasures, the thickening may result in a significant loss in missile range due to the added weight. As a result, a design tradeoff must be made in current guided missiles between the need to provide the warhead protection from mechanical countermeasures and the need to propel that warhead over long distances. A need thus exists to provide adequate protection to guided missile warheads while not, in the process of providing such protection, adding an amount of weight which significantly reduces the range of the missile.

SUMMARY OF THE INVENTION

The present invention solves the problem of providing a guided missile warhead adequate protection from mechanical countermeasures while adding a tolerable amount of weight to the missile structure. As a result, the range of a missile is essentially unaffected while warhead protection and penetration resistance is enhanced. A layered combination of materials is retained in an enclosure which is attached to the forward end of a warhead encasement. The warhead encasement need not be thickened for the purpose of protecting warhead components although some thickening is still an option. The majority, by volume, of layer forming materials are lightweight as compared to an equivalent thickness of solid metal yet the arrangement provides essentially the same or improved resistance to penetration by mechanical countermeasure than would a similar thickness of metal.

It is an object of the invention to provide enhanced protection to a guided missile warhead from mechanical countermeasures.

It is a further object of the invention to provide enhanced guided missile warhead protection by the use of armoring materials which are capable of blunting, breaking and stopping countermeasure projectiles or fragments before the countermeasure is able to destroy or damage the warhead.

Still a further object of the invention is to provide armored protection to a guided missile warhead which does not appreciably add to the weight of the overall guided missile structure.

The nature of this invention as well as other objects and advantages thereof will be readily apparent from consideration of the following specification as related to the accompanying drawings.

DESCRIPTION OF THE PREFERRED EMBODIMENT

Figure 1:
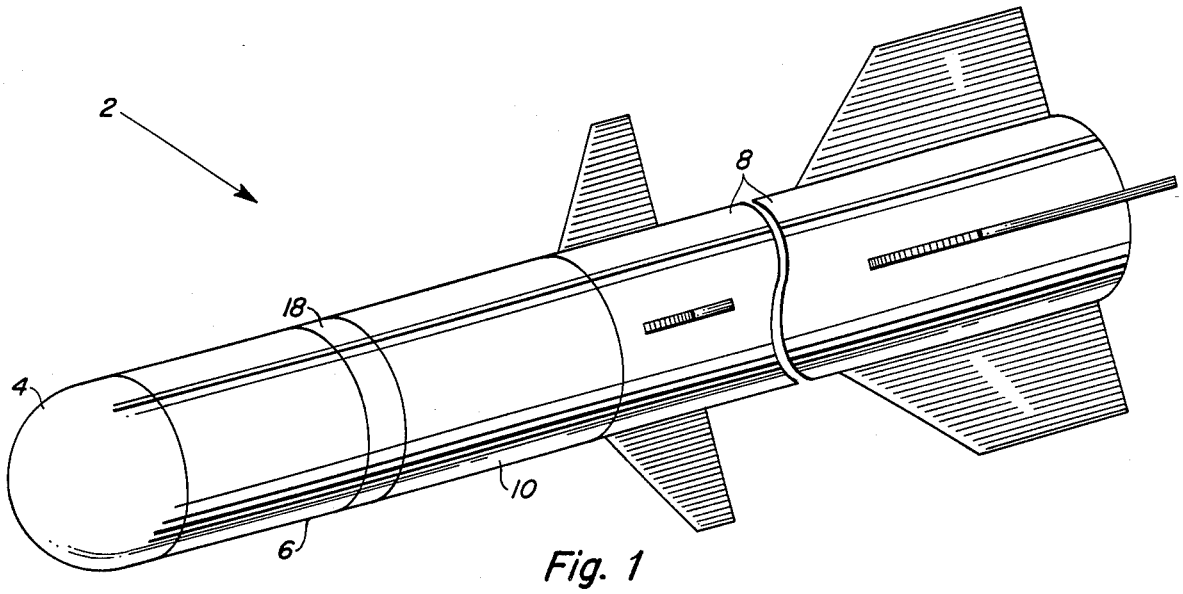
FIG. 1 is a perspective view of a long range guided missile demonstrating a typical arrangement of component sections.

The armoring arrangement of the present invention provides enhanced resistance to penetration and destruction by a projectile to a guided missile warhead at an acceptably small increase in overall missile weight. It has been determined that when a layer of metal armor is backed by a layer of polymethylmethacrylate the penetration resistance of the combination is enhanced at little increase in weight. Similarly, it has been found that a lesser thickness of metal backed by a layer of polymethylmethacrylate will provide essentially the same and possibly better penetration resistance as compared to a thicker and much heavier unbacked thickness of metal armor. Still further enhancement in the amount of protection provided a warhead from mechanical countermeasure impact is accomplished when a layer of ceramic material is placed forward of at least one layered combination of metal armor backed by polymethylmethacrylate. The ceramic layer blunts an impinging projectile and can cause the projectile to break into fragments.

In sequence then, a projectile which encounters a thickness of ceramic, the ceramic preferably being aluminum oxide, will be blunted or broken upon impact. This impact significantly reduces the kinetic energy of the projectile or its fragments. The projectile or fragments upon next encountering a layer of metal, preferably high strength steel, will be further broken up and will lose an additional amount of kinetic energy. Unlike the brittle ceramic the metal layer will not tend to break but will tend to hold together absorbing significant amounts of kinetic energy while preventing further penetration toward the interior of the warhead. Each fragment or a projectile which accomplishes the penetration of the metal layer next encounters a layer of polymethylmethacrylate. This material exhibits a high degree of resistance to penetration and while it may undergo significant deformation at an impact point, complete penetration of the polymethylmethacrylate layer is unlikely. Further penetration resistance is achieved by the use of additional layers of metal each of which is backed by a layer of polymethylmethacrylate. The number of layers added is constrained only by the available volume in which to accommodate the material and the amount of added weight which can be tolerated.

The mode of the invention deemed most advantageous to the protection of a guided missile warhead includes the use of a metal cup to enclose the layers of material mentioned above. The preferred metal is a high strength steel although other metals or alloys may be utilized. The use of a cuplike enclosure is advantageous in several respects. The closed end of the cup forms a first metal bulkhead which a projectile must penetrate in order to reach the warhead. Additionally, the closed end of the cup can easily be configured to accommodate the attachment of a missile section forward of it and the open end of the cup is easily configured to be attached to the forward end of existing warhead sections which are configured for the attachment of forward missile sections.

Referring now to FIG. 1, a typical long range guided missile 2 is shown in perspective. The missile illustrated includes a nose section 4, a guidance or control section 6, and a motor section 8. Warhead encasement 10 with armoring cup 18 is shown mounted between guidance or control section 6 and motor section 8.

Figure 2:
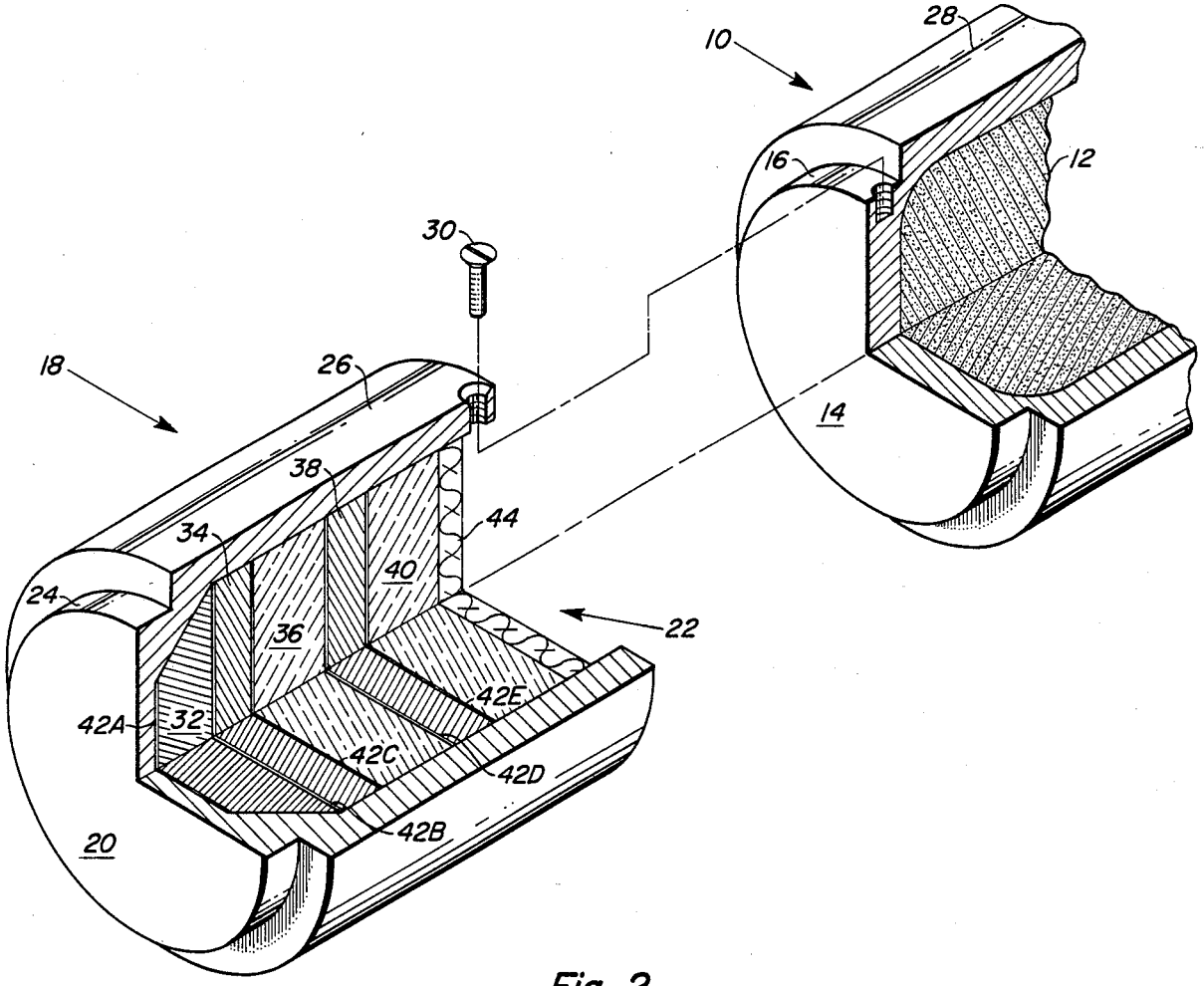
FIG. 2 is a one-quarter cutaway perspective view of the present invention.

Referring now to FIG. 2, an armoring arrangement of the present invention is illustrated attached to a warhead. Existing metal warhead encasement 10 which contains explosive 12 has a forward encasement bulkhead 14 having a mounting lip 16. Cylindrical metal armoring cup 18 has a closed end which forms forward cup bulkhead 20 and an open aft end 22. Forward cup bulkhead 20 has a mounting lip 24 which in most instances will be dimensionally identical to mounting lip 16 of encasement 10. Open aft end 22 of cup 18 fits onto mounting lip 16 of encasement 10 to accommodate the rigid and secure attachment of cup 18 to encasement 10. FIG. 1 demonstrates the attachment of cup 18 to encasement 10 by use of machine screws 30. Any number of other standard fasteners could be used for this purpose. The use of a crimping process to attach cup 18 to encasement 10 has been suggested as has the possibility of heating cup 18 prior to its attachment and allowing it to shrink onto encasement 10 as it cools. When cup 18 is attached to encasement 10 exterior surface 26 of cup 18 is conformal with respect to exterior surface 28 of encasement 10.

Prior to the installation of cup 18 on encasement 10 several layers of material are inserted into cup 18. First, a layer of ceramic material 32 is inserted into cup 18. Ceramic layer 32 is dimensioned to fit snugly into cup 18 and abuts the internal face of forward cup bulkhead 20. After ceramic layer 32 is inserted, metal plate 34 is inserted into cup 18. Metal plate 34 fits snugly into cup 18 and abuts ceramic layer 32. A layer of polymethylmethacrylate 36 is inserted into cup 18 after metal plate 34. Polymethylmethacrylate layer 36 fits snugly into cup 18 and abuts metal plate 34. Additional pairs of layered meterials such as metal plate 38 and polymethylmethacrylate layer 40 may then be inserted into cup 18 depending upon volumetric and weight constraints.

As previously noted, while many metals can be utilized in fabricating the structure of a guided missile, the use of a high strength steel to form encasement 10, cup 18, and metal plates 34 and 38 has proven to be highly satisfactory.

The use of an adhesive at interfaces 42A, 42B, 42C, 42D, and 42E, and at any other such interface formed by the addition of more layers of metal backed by polymethylmethacrylate, is optional and may be advantageous to bond the various layers of material into cup 18 and to each other.

It may also be advantageous or necessary to include a spacer layer 44 between the final layer of polymethylmethacrylate and the outside face of forward encasement bulkhead 14 of encasement 10 to fill any void which might otherwise exist at that location after cup 18 is attached to encasement 10. The use of a feltlike compressible material is contemplated in this regard.

Many modifications and variations of the present invention are obvious in light of the above teachings and it is therefore to be understood that within the scope of the appended claims the invention may be practiced otherwise than as specifically described.

We claim:

1. A construction to enhance the survivability of a guided missile warhead against mechanical countermeasures, which comprises:

a cylindrical metal armoring cup having an open aft end and a closed forward end which forms a forward bulkhead;

a ceramic layer inserted into said cup, said ceramic layer dimensioned to fit snugly into said cup and to abut said forward bulkhead;

a metal plate inserted into said cup, said metal plate dimensioned to fit snugly into said cup and to abut said ceramic layer;

a layer of polymethylmethacrylate inserted into said cup, said polymethylmethacrylate layer dimensioned to fit snugly into said cup and to abut said metal plate; and means for attaching said open aft end of said cup to the end of said warhead which is to be oriented toward a target at which said warhead is to be launched.

2. A construction according to claim 1 wherein said ceramic layer is a layer of aluminum oxide.

3. A construction according to claim 1 wherein said metal armoring cup is a steel cup; and, said metal plate is a steel plate.

4. A construction according to claim 1 wherein said ceramic layer is bonded to said metal cup by an adhesive; said metal plate is bonded to said ceramic layer by an adhesive; and, said layer of polymethylmethacrylate is bonded to said metal plate by an adhesive.

5. A construction to enhance the survivability of a guided missile warhead against mechanical countermeasures, which comprises:

a cylindrical metal armoring cup having an open aft end and a closed forward end which forms a forward bulkhead;

a ceramic layer inserted into said cup, said ceramic layer dimensioned to fit snugly into said cup and to abut said forward bulkhead;

a first metal plate inserted into said cup, said first metal plate dimensioned to fit snugly into said cup and to abut said ceramic layer;

a first layer of polymethylmethacrylate inserted into said cup, said polymethylmethacrylate layer dimensioned to fit snugly into said cup and to abut said first metal plate;

at least one additional metal plate inserted into said cup;

an additional layer of polymethylmethacrylate inserted into said cup after the insertion of each additional metal plate; and means for attaching said open aft end of said cup to the end of said warhead which is to be oriented toward a target at which said warhead is to be launched.

6. A construction according to claim 5 wherein said metal armoring cup is a steel cup; said first metal plate is a steel plate; and, each additional metal plate is a steel plate.

7. A construction according to claim 5 wherein said ceramic layer is a layer of aluminum oxide.

8. A construction according to claim 5 wherein said ceramic layer is bonded to said metal armoring cup by an adhesive; said first metal plate is bonded to said ceramic layer by an adhesive; said first layer of polymethylmethacrylate is bonded to said first metal plate by an adhesive; and, each of said additional metal plates is bonded by an adhesive to the layers of polymethylmethacrylate between which it is located.

9. A construction according to claim 5 wherein:

said ceramic layer has a thickness of from one-quarter to one-half of one inch;

said metal plates have a thickness of from one-tenth to one-quarter of one inch; and said layers of polymethylmethacrylate have a thickness of from one-quarter of one inch to one inch.

10. A construction according to claim 6 wherein:

said layer of aluminum oxide has a thickness of from one-quarter to one-half of one inch;

said steel plates have a thickness of from one-tenth to one-quarter of one inch; and said layers of polymethylmethacrylate have a thickness of from one-quarter of one inch to one inch.

* * * * *